US005503358A

United States Patent [19]

Lapp

[11] Patent Number: 5,503,358

[45] Date of Patent: Apr. 2, 1996

[54] SUSPENDED WALL SCAFFOLD STRUCTURE

[76] Inventor: Levi Lapp, 245 Hill Rd., New Holland, Pa. 17557

[21] Appl. No.: 261,274

[22] Filed: Jun. 13, 1994

[51] Int. Cl.[6] ..... E04G 3/08

[52] U.S. Cl. ..... 248/235; 182/82; 248/291.1

[58] Field of Search ..... 248/235, 214, 248/293, 286, 287; 182/82, 150

[56] References Cited

U.S. PATENT DOCUMENTS

| | | | |
|---|---|---|---|
| 1,558,425 | 10/1925 | Yetter | 248/235 |
| 2,121,704 | 6/1938 | Leeworthy | 248/235 |
| 3,322,387 | 5/1967 | Fortin, Sr. | 248/235 |
| 3,595,510 | 7/1971 | Hutchinson | 248/235 |
| 4,122,916 | 10/1978 | Strobel | 182/82 |
| 4,153,229 | 5/1979 | Bequette | 182/82 |
| 4,452,336 | 6/1984 | Sickler | 182/82 |
| 4,957,185 | 9/1990 | Courchesne et al. | 182/150 |
| 4,971,169 | 11/1990 | Fruth | 182/119 |
| 5,067,586 | 11/1991 | Myers | 182/45 |

FOREIGN PATENT DOCUMENTS

| | | | |
|---|---|---|---|
| 2102535 | 3/1972 | France | 182/82 |

*Primary Examiner*—Leslie A. Braun
*Assistant Examiner*—Anita M. King

[57] ABSTRACT

A scaffold structure which may be suspended from the top of a wall to support wooden planks or the like in an elevated, horizontal position. The structure includes a main support member having a hanging bracket for engaging the top of the wall to support the main support member vertically along the wall. A platform member orthogonally projects from the main support member and receives the planks thereon. A brace member is connected to and extends between the main support member and the platform member to rigidify the structure of the invention. The structure may be compactly folded for transportation and storage, and an extension member is provided to facilitate positioning of the scaffolding atop second story or higher walls.

4 Claims, 4 Drawing Sheets

FIG 1
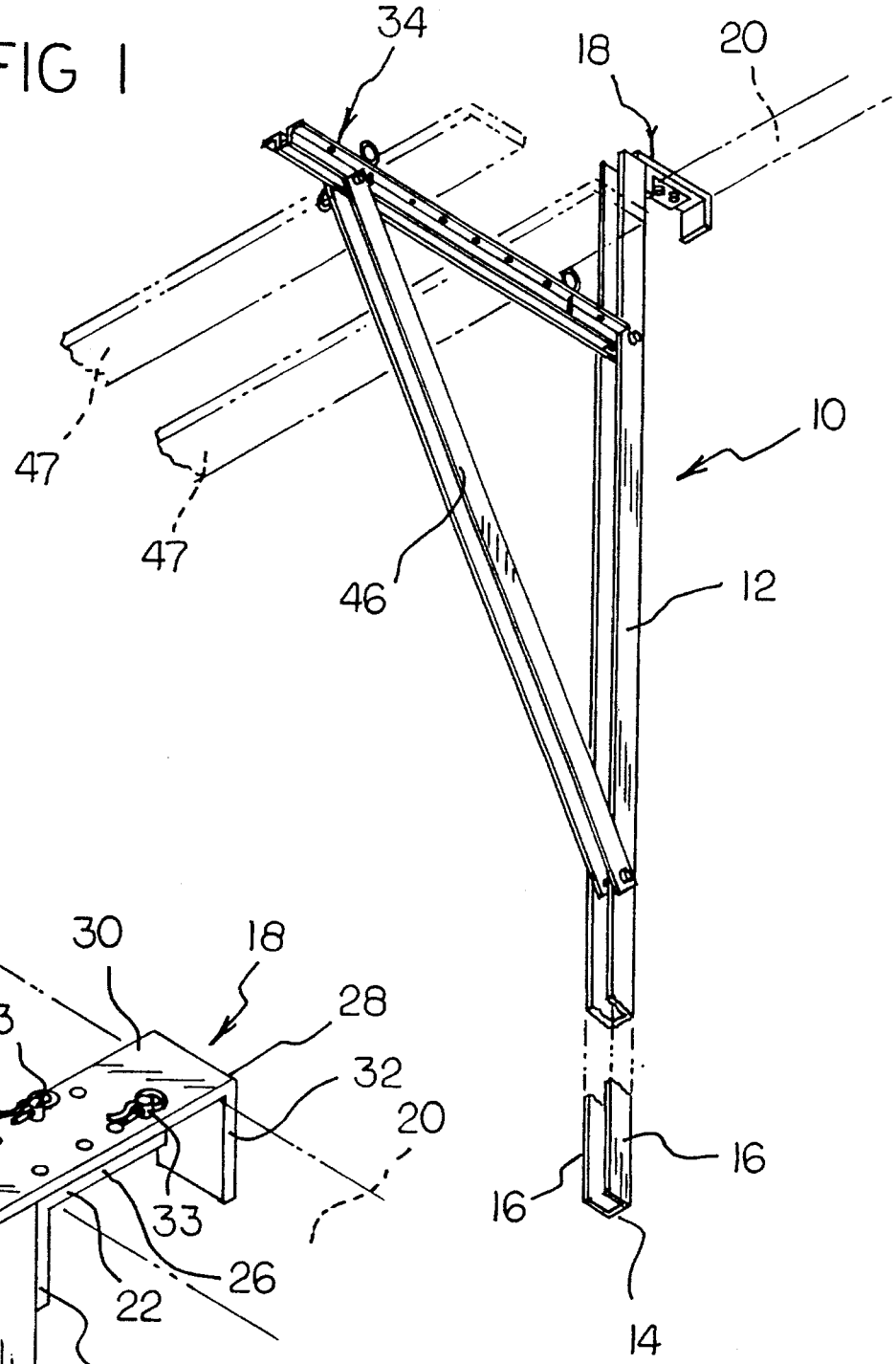
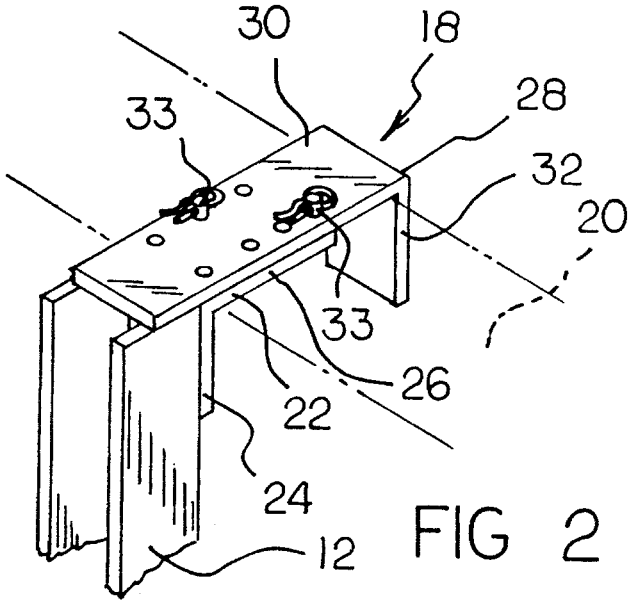
FIG 2

45a
44
34
36
45b
45b
45a
44
40
38
42
42
12
42
50
46
10
48

14
16
16
34
38
10
42
12

48
52
46

SUSPENDED WALL SCAFFOLD STRUCTURE

BACKGROUND OF THE INVENTION

1. Field of the Invention

The present invention relates to scaffolding and more particularly pertains to a suspended wall scaffold structure which may be suspended from the top of a wall to support wooden planks in an elevated, horizontal position.

2. Description of the Prior Art

The use of scaffolding is known in the prior art. More specifically, scaffolds heretofore devised and utilized for the purpose of supporting an individual proximate a wall structure are known to consist basically of familiar, expected and obvious structural configurations, notwithstanding the myriad of designs encompassed by the crowded prior art which have been developed for the fulfillment of countless objectives and requirements.

For example, a method and apparatus for scaffolding is disclosed in U.S. Pat. No. 4,971,169 which may be suspended from the cap or upper header of a building wall. The scaffold is also useable as a saw horse and a ground-floor supported scaffold.

Another patent of interest is U.S. Pat. No. 4,957,185 which teaches a roof scaffold bracket for suspending scaffolding from a pitched roof in such a manner as to permit roofing of the edge of the roof without interference, the scaffolding bracket being of such a structure so as to permit easy adjustment and installation and subsequent removal thereof.

Other known prior art scaffolds include U.S. Pat. No. 4,122,916 and U.S. Pat. No. 5,067,586.

While these devices fulfill their respective, particular objectives and requirements, the aforementioned patents do not disclose a suspended wall scaffold structure which may be suspended from the top of a wall to support wooden planks in an elevated, horizontal position which includes a main support member having a hanging bracket for engaging the top of the wall to suspend the main support member vertically along the wall, a platform member orthogonally projecting from the main support member to receive the planks thereon, and an extension member for facilitating positioning of the scaffolding atop second story or higher building walls.

In these respects, the suspended wall scaffold structure according to the present invention substantially departs from the conventional concepts and designs of the prior art, and in so doing provides an apparatus primarily developed for the purpose of supporting wood planks or the like in an elevated, horizontal position adjacent a wall structure.

SUMMARY OF THE INVENTION

In view of the foregoing disadvantages inherent in the known types of scaffolds now present in the prior art, the present invention provides a new suspended wall scaffold structure construction wherein the same can be utilized for supporting wooden planks or the like in an elevated, horizontal position adjacent a wall structure. As such, the general purpose of the present invention, which will be described subsequently in greater detail, is to provide a new suspended wall scaffold structure apparatus and method which has many of the advantages of the scaffolds mentioned heretofore and many novel features that result in a suspended wall scaffold structure which is not anticipated, rendered obvious, suggested, or even implied by any of the prior art scaffolds, either alone or in any combination thereof.

To attain this, the present invention generally comprises a scaffold structure which may be suspended from the top of a wall to support wooden planks or the like in an elevated, horizontal position. The structure includes a main support member having a hanging bracket for engaging the top of the wall to support the main support member vertically along the wall. A platform member orthogonally projects from the main support member and receives the planks thereon. The structure may be compactly folded for transportation and storage, and an extension member is provided to facilitate positioning of the scaffolding atop second story or higher walls.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new suspended wall scaffold structure apparatus and method which has many of the advantages of the scaffolds mentioned heretofore and many novel features that result in a suspended wall scaffold structure which is not anticipated, rendered obvious, suggested, or even implied by any of the prior art scaffolds, either alone or in any combination thereof.

It is another object of the present invention to provide a new suspended wall scaffold structure which may be easily and efficiently manufactured and marketed.

It is a further object of the present invention to provide a new suspended wall scaffold structure which is of a durable and reliable construction.

An even further object of the present invention is to provide a new suspended wall scaffold structure which is susceptible of a low cost of manufacture with regard to both materials and labor, and which accordingly is then susceptible of low prices of sale to the consuming public, thereby making such suspended wall scaffold structures economically available to the buying public.

Still yet another object of the present invention is to provide a new suspended wall scaffold structure which provides in the apparatuses and methods of the prior art some of the advantages thereof, while simultaneously overcoming some of the disadvantages normally associated therewith.

Still another object of the present invention is to provide a new suspended wall scaffold structure for supporting wooden planks or the like in an elevated, horizontal position adjacent a wall structure.

Yet another object of the present invention is to provide a new suspended wall scaffold structure which includes a main support member having a hanging bracket for engaging the top of the wall to suspend the main support member vertically along the wall, a platform member orthogonally projecting from the main support member for supporting the planks thereon, and an extension member for facilitating a positioning of the scaffolding atop a second story or higher building wall.

Even still another object of the present invention is to provide a new suspended wall scaffold structure which may be compactly folded for transportation and storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a suspended wall scaffold structure comprising the present invention.

FIG. 2 is an enlarged isometric illustration of a portion of the present invention.

DESCRIPTION OF THE PREFERRED EMBODIMENT

Figure 3:
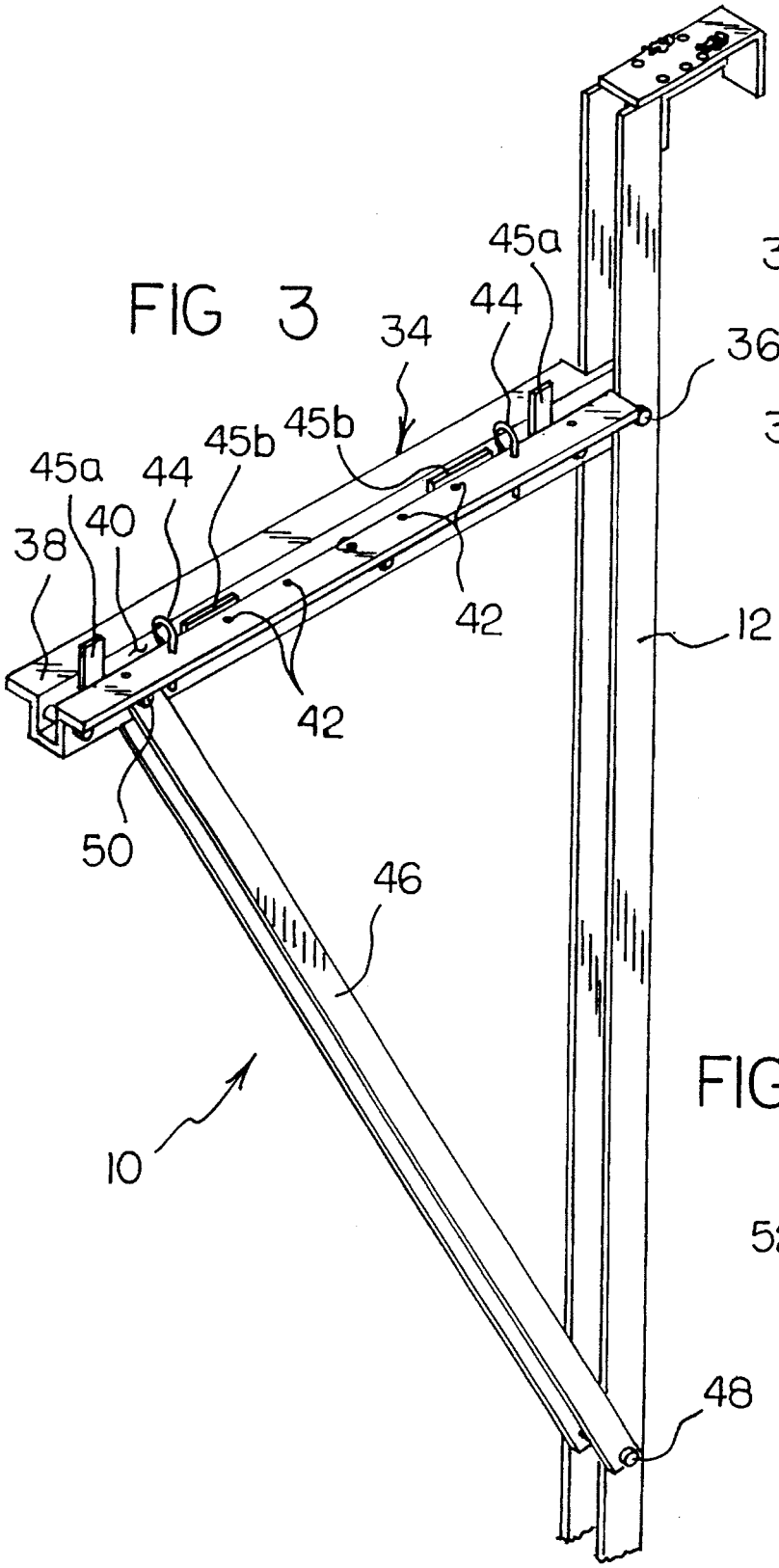
FIG. 3 is a further isometric illustration of the invention.

With reference now to the drawings, and in particular to FIGS. 1–8 thereof, a new suspended wall scaffold structure embodying the principles and concepts of the present invention and generally designated by the reference numeral 10 will be described.

More specifically, it will be noted that the suspended wall scaffold structure 10 comprises a main support member 12 having a substantially straight, elongated shape and having a base wall 14 with a pair of spaced side walls 16 orthogonally projecting from opposed edges of the base wall to define a substantially C-shaped channel. The main support member 12 includes a top end and a bottom end with a hanging bracket 18 coupled to the top end thereof for suspending the main support member 12 in a vertical orientation along a wall 20, as best illustrated in FIG. 1. The hanging bracket 18, as illustrated in FIG. 2, comprises a first L-shaped member 22 having a first vertical leg 24 mounted to the main support member 12 and a first horizontal leg 26 orthogonally extending from the vertical leg. A second L-shaped member 28 is movably coupled to the first L-shaped member 22 and includes a second horizontal leg 30 orthogonally coupled to a second vertical leg 32, with the horizontal legs 26, 30 including a plurality of spaced, selectively alignable apertures, whereby pins 33 may project through the apertures to secure the second L-shaped member 28 in various positions relative to the first L-shaped member 22, thereby varying a spacing between the first vertical leg 24 and the second vertical leg 32 to accommodate various widths of walls 20 captured therebetween. By this structure, the main support member 12 may be suspended by the hanging bracket 18 from the top end of the wall 20 as illustrated in FIGS. 1 and 6.

A platform member 34 is pivotally connected to the main support member 12 by a platform pivot pin 36, as best illustrated in FIG. 3. The platform member 34 is comprised of a length of hat channel 38 having a center channel 40 extending longitudinally therealong. A plurality of pin apertures 42 extends through the platform member 34 and allows for selective placement of a plurality of plank retaining pins 44 which operate to preclude movement of planks 47 positionable upon the platform member 34. However, in lieu of the plank retaining pins 44, a plurality of pivoting retainer members **45*a* and 45*b* may be pivotally mounted within the center channel 40 of the platform member 34. The retaining members 45*a* and 45*b* are arranged in an outer pair 45*a* and an inner pair 45*b* and are pivotally mounted such that they may lie flat, as illustrated in FIG. 3 for the inner pair, or be vertically extended, as illustrated for the outer pair 45*a***, with the pivoting of the retaining members being limited so as to not permit pivoting past the position shown for the outer pair of retaining members.

Figure 4:
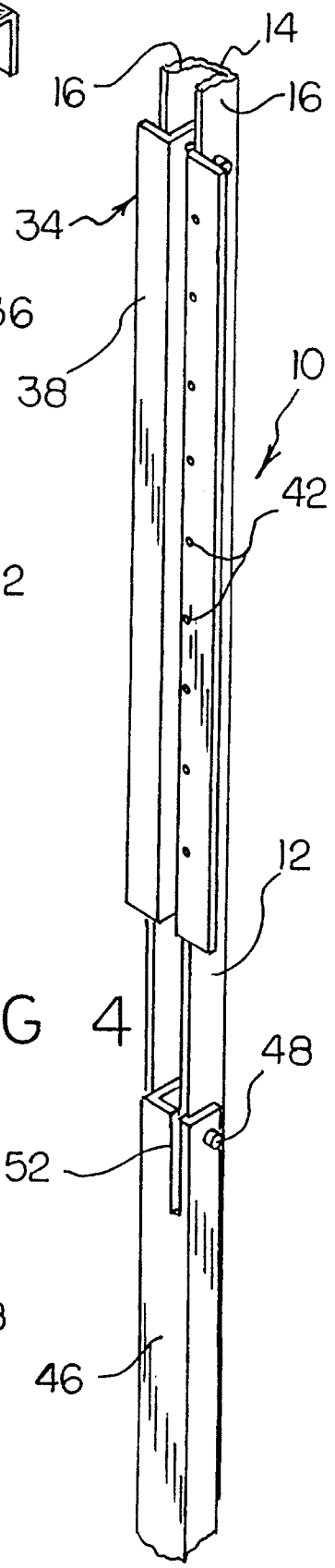
FIG. 4 is an isometric illustration of the invention folded for transportation and/or storage.

To support the platform member 34 orthogonal relative to the main support member 12, a brace member 46 is pivotally connected to the main support member 12 by a lower brace pivot pin 48 and to the platform member 34 by an upper brace pivot pin 50, with either of the pivot pins 48, 50 being removable to facilitate folding of the device 10 as illustrated in FIG. 4. Specifically, the platform member 34 is configured so as to be positionable at least partially between the side walls 16 of the main support member 12. It should be noted that the brace member 46 preferably includes a slot 52 which permits pivoting of the brace member relative to the main support member 12.

Figure 5:
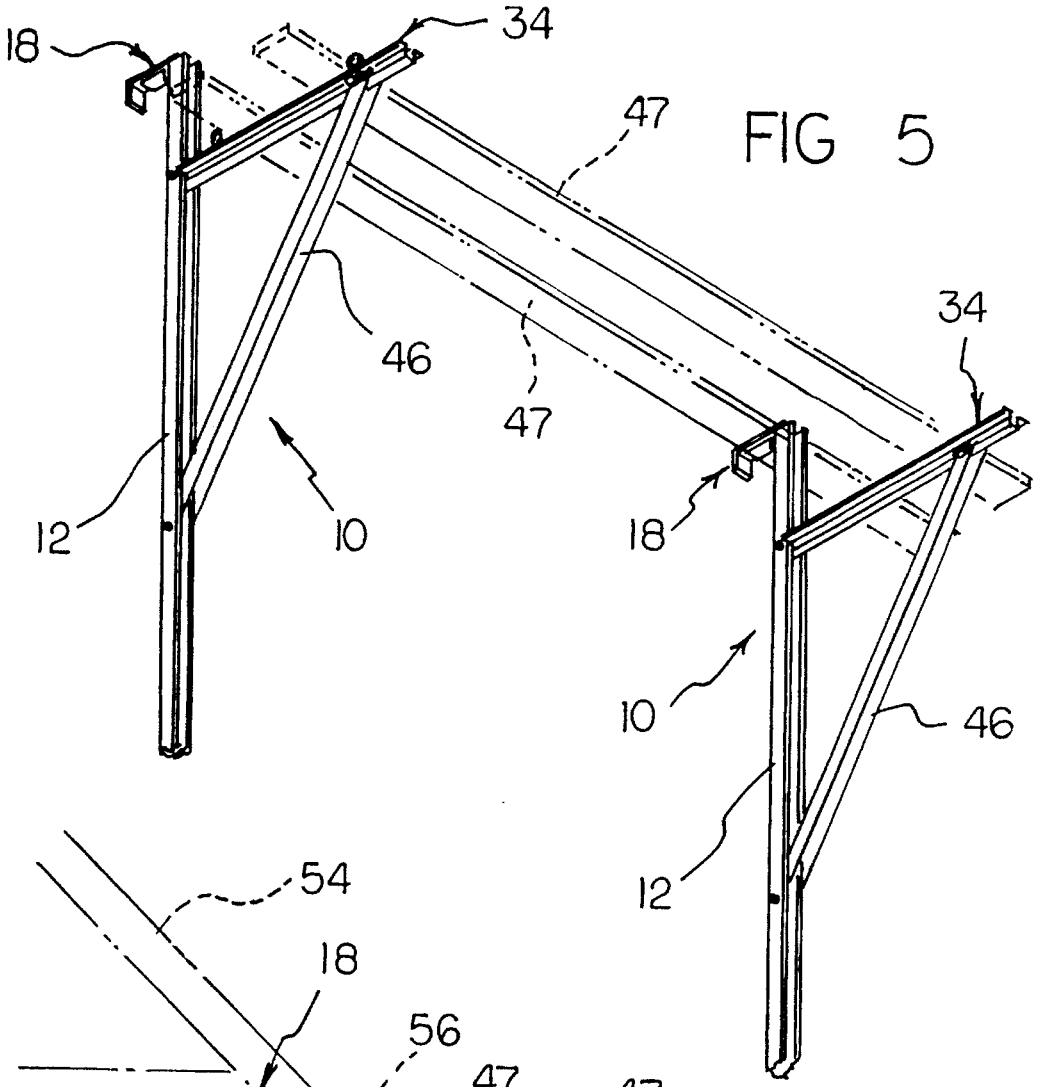
FIG. 5 is an isometric illustration of the invention in use.
Figure 6:
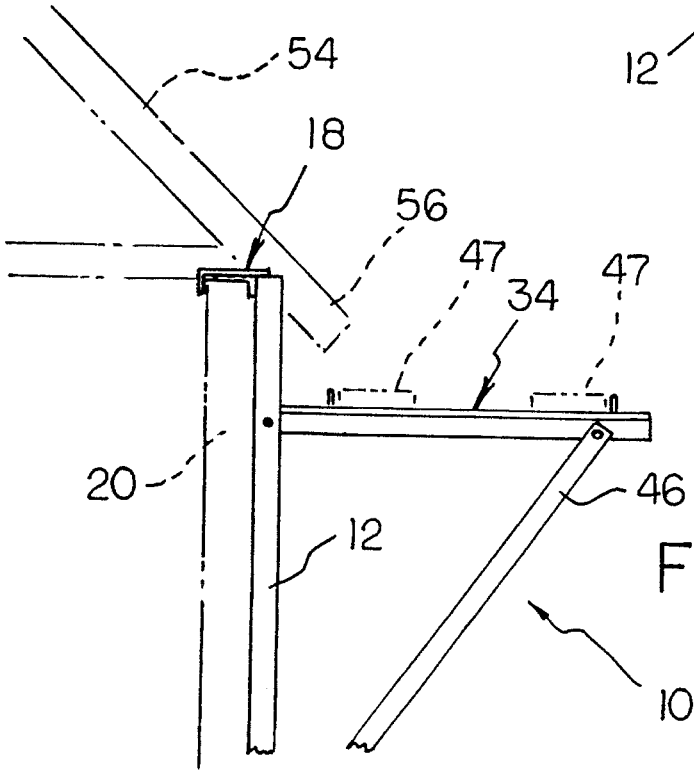
FIG. 6 is a side elevation view illustrating the present invention engaged to a wall proximate a roof.
Figure 7:
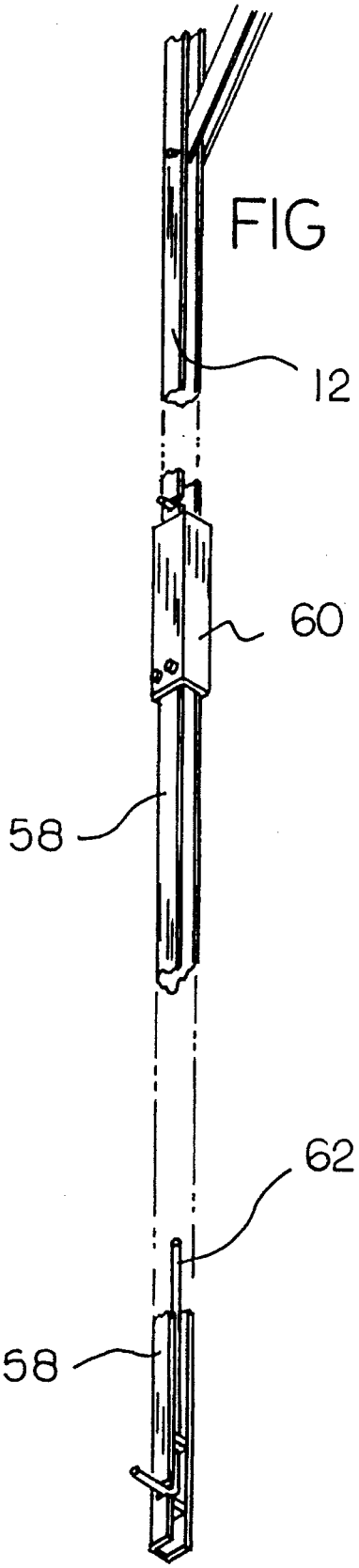
FIG. 7 is an isometric illustration of the suspended wall scaffold structure including an extension member.
Figure 8:
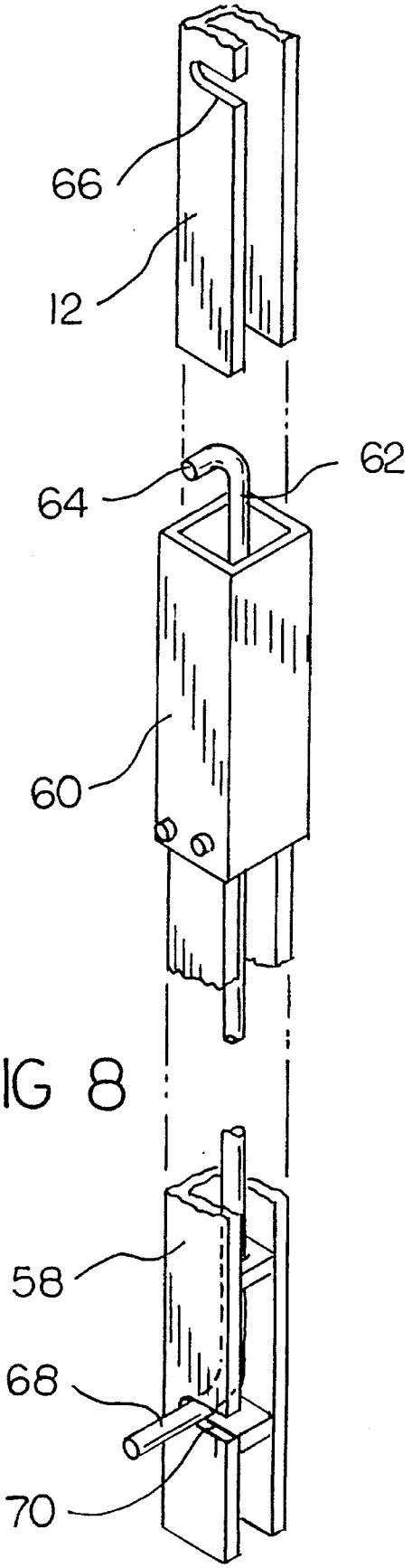
FIG. 8 is an enlarged, isometric view illustrating an interconnection between the main support member and the extension member.

As best illustrated in FIGS. 5 and 6, the present invention 10 is preferably used in pairs to support the wooden planks 47 as illustrated. Specifically, the hanging bracket 18 is engagable to the top end of the wall 20 of a newly constructed, unfinished house in which roofing is to be applied to the roof 54 thereof, whereby the platform member 34 is sufficiently spaced from the hanging bracket 18 to allow for clearance of the eave 56 of the associated roof 54, whereby a roofer or other workman may stand upon the planks 47. The spacing of the planks may be adjusted by positioning the plank retaining pins 44 in any one of the plurality of pin apertures 42.

To install the scaffold structure upon the wall 20 an individual standing on the ground adjacent the wall may grasp the main support member 12 by the bottom end thereof and position the hanging bracket 18 over the top end of the wall 20. To facilitate positioning of the hanging bracket 18 onto the top end of a second story or higher wall 20, an extension member 58 is provided and illustrated in FIGS. 7 and 8. The extension member 58 includes a coupler 60 operable to receive both a portion of the extension member and of the main support member 12 with the coupler 60 being fixedly secured to the extension member. A locking rod 62 is pivotally mounted within the extension member 58 and includes an upper orthogonal portion 64 engagable to a main support member slot 66 formed proximate the bottom end of the main support member 12. The locking rod further includes a lower portion 68 positionable within an extension member slot 70 of the extension member 58. By this structure, the extension member 58 may be coupled to the main support member 12 by engaging the upper portion 64 of the locking rod 62 to the main support member slot 66 of the main support member 12, whereby positioning of the hanging bracket 18 atop a second story or higher wall may be accomplished and the extension member 58 subsequently released from the main support member 12 by a pivoting of the lower portion 68 from the extension member slot 70, thereby pivoting the upper portion 64 of the locking rod 62 from the main support member slot 66 and decoupling the extension member from the main support member in a now readily apparent manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A new suspended wall scaffold structure comprising:

a main support member having a substantially straight, elongated shape with a top end and a bottom end, the main support member having a main support member slot proximal to the bottom end thereof;

a hanging bracket coupled to the top end of the main support member for suspending the main support member from a wall in a vertical orientation along the wall;

a platform member pivotally connected to the main support member by a platform pivot pin;

a brace member connected to the main support member and to the platform member;

an extension member having an extension member slot formed therein and a coupler operable to receive a portion of the main support member, a locking rod pivotally mounted within the extension member, the locking rod including an upper orthogonal portion engagable to the main support member slot and a lower portion positionable within the extension member slot of the extension member, whereby the extension member is releasably coupled to the main support member by engaging the upper portion of the locking rod to the main support member slot of the main support member, whereby positioning of the hanging bracket atop at least a second story wall can be accomplished.

2. A new suspended wall scaffold structure as recited in claim 1, wherein the hanging bracket comprises a first L-shaped member having a first vertical leg mounted to the main support member and a first horizontal leg orthogonally extending from the first vertical leg, a second L-shaped member having a second horizontal leg orthogonally coupled to a second vertical leg, with the horizontal legs including a plurality of spaced, selectively alignable apertures; and at least one pin, whereby the at least one pin may project through the apertures to secure the second L-shaped member in various positions relative to the first L-shaped member, thereby varying a spacing between the first vertical leg and the second vertical leg.

3. A suspended wall scaffold structure comprising:

a main support member having a substantially straight, elongated shape with a top end and a bottom end;

a hanging bracket coupled to the top end of the main support member for suspending the main support member from a wall in a vertical orientation along the wall;

a platform member pivotally connected to the main support member by a platform pivot pin;

a brace member connected to the main support member and to the platform member;

an extension member having a coupler mounted thereto and, the coupler being releasable engaged with the main support member, whereby positioning of the hanging bracket atop at least a second story wall can be accomplished by remote manipulation of the main support member by the extension member.

4. The suspended wall scaffold structure of claim 3, wherein the coupler is mounted to an upper end of the extension member and receives the bottom end of the main support member to removably couple the extension member with the main support member.

* * * * *